US009364381B1

(12) United States Patent
Lunt

(10) Patent No.: US 9,364,381 B1
(45) Date of Patent: Jun. 14, 2016

(54) HANDY HANDLE SYSTEMS

(71) Applicant: Charles Lunt, Cedar City, UT (US)

(72) Inventor: Charles Lunt, Cedar City, UT (US)

( * ) Notice: Subject to any disclaimer, the term of this patent is extended or adjusted under 35 U.S.C. 154(b) by 0 days.

(21) Appl. No.: 14/314,972

(22) Filed: Jun. 25, 2014

Related U.S. Application Data

(60) Provisional application No. 61/841,685, filed on Jul. 1, 2013.

(51) Int. Cl.
*A61G 17/04* (2006.01)

(52) U.S. Cl.
CPC ..... *A61G 17/04* (2013.01); *A61G 2017/041* (2013.01); *Y10T 16/4701* (2015.01)

(58) Field of Classification Search
CPC . A61G 17/04; A61G 2017/041; A47B 95/02; B25G 1/04; B25G 3/20; B25G 3/24; B25G 3/38; Y10T 16/4701; Y10T 16/4707; Y10T 16/4713; Y10T 16/4719; Y10T 16/469; Y10T 16/501; Y10T 16/498; Y10T 16/44; Y10T 74/20744; Y10T 74/20828; Y10T 74/20834
USPC ..... 27/2, 27; D99/8; 16/424–427, 439, 422, 16/436, 110.1; 220/759; 294/27.1, 15, 294/68.1; 74/544, 551.8, 551.9
See application file for complete search history.

(56) References Cited

U.S. PATENT DOCUMENTS

| | | | | | |
|---|---|---|---|---|---|
| 270,620 | A | | 1/1883 | Wilson | |
| 275,665 | A | * | 4/1883 | Johnson | 27/27 |
| 520,015 | A | * | 5/1894 | Bannister | 16/424 |
| 532,073 | A | | 1/1895 | Klar | |
| 576,358 | A | * | 2/1897 | Antes | 16/424 |
| 648,983 | A | | 5/1900 | Niemeyer | |
| 687,889 | A | * | 12/1901 | Kulp | 16/424 |
| 737,580 | A | * | 9/1903 | Carpenter | 27/27 |
| 878,985 | A | * | 2/1908 | Montross | 27/27 |
| 937,086 | A | * | 10/1909 | Montross | 27/27 |
| 941,072 | A | * | 11/1909 | Huber | 294/154 |
| 2,759,239 | A | * | 8/1956 | Snyder | 27/27 |
| 2,802,253 | A | * | 8/1957 | Birck | 27/27 |
| D218,890 | S | * | 10/1970 | Kreminski | D99/8 |
| 4,315,354 | A | * | 2/1982 | Behrendt | 27/27 |
| 4,930,197 | A | * | 6/1990 | McClive | 27/2 |
| 5,522,116 | A | * | 6/1996 | Enneking et al. | 16/424 |
| 5,531,000 | A | * | 7/1996 | Biondo | 27/27 |
| 5,555,612 | A | * | 9/1996 | Biondo | 27/2 |
| 5,586,376 | A | * | 12/1996 | Enneking et al. | 27/27 |
| 6,754,940 | B1 | * | 6/2004 | Boots | 27/27 |
| 7,213,312 | B2 | * | 5/2007 | Foroni | 27/4 |
| 7,249,403 | B2 | * | 7/2007 | Davis et al. | 27/27 |
| 8,112,851 | B1 | * | 2/2012 | Hughes | 27/27 |
| 2010/0327177 | A1 | * | 12/2010 | Flynn | 250/395 |
| 2014/0115843 | A1 | * | 5/2014 | Jenson | 27/27 |

* cited by examiner

*Primary Examiner* — William Miller
(74) *Attorney, Agent, or Firm* — RG Patent Consulting, LLC; Rachel Gilboy

(57) ABSTRACT

A casket carrying device that is designed to allow for much easier transporting of the coffin from a funeral to a graveside service allowing it to be maneuvered more easily, even up and down flights of stairs as necessary. The handle members may be about five inches wide. The handles may have two top slightly curved portions measuring about two inches across. The handy handle features a pivot rod about 18 inches in length and 1-1½ inches in diameter that allows for the handle to be used on either side of the casket. The handle may fold when not used (when not in extension) to become parallel with the casket. The handles when properly used put less strain on the casket bearers since they provide functionally accessible handles.

16 Claims, 5 Drawing Sheets

HANDY HANDLE SYSTEMS

CROSS-REFERENCE TO RELATED APPLICATION

The present application is related to and claims priority from prior provisional application Ser. No. 61/841,685, filed Jul. 1, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of carrying means and more specifically relates to a manual casket lifting and carrying system.

2. Description of the Related Art

A funeral is a ceremony for celebrating, respecting, sanctifying, or remembering the life of a person who has died. Funerary customs comprise the complex of beliefs and practices used by a culture to remember the dead, from interment itself, to various monuments, prayers, and rituals undertaken in their honor. Customs vary widely between cultures, and between religious affiliations within cultures. Western cultures often bury the dead in caskets. Caskets can be very expensive and may be difficult to carry across varied terrains, given the fact they are often heavy. A means whereby carrying the casket between locations is made comfortable is desirable.

Various attempts have been made to solve the above-mentioned problems such as those found in U.S. Pat. No. 648,983 to Henry Wm Niemeyer, U.S. Pat. No. 532,073 to Jacob Klar, and U.S. Pat. No. 270,620 to Ohaeles E. Wilson. This art is representative of carrying means. None of the above inventions and patents, taken either singly or in combination, is seen to describe the invention as claimed.

Ideally, a manual casket lifting and carrying means should provide ease of use and proper esthetics yet would operate reliably and be manufactured at a modest expense. Thus, a need exists for a reliable manual casket lifting and carrying system to avoid the above-mentioned problems.

BRIEF SUMMARY OF THE INVENTION

In view of the foregoing disadvantages inherent in the known carrying means for use in stabilizing carried devices art, the present invention provides a novel manual casket lifting and carrying system. The general purpose of the present invention, which will be described subsequently in greater detail is to provide greater comfort and stability when carrying caskets.

A manual casket lifting and carrying system is disclosed herein comprising: a manual casket lifting and carrying assembly comprising a handle member (having a body, a proximate end, a distal end, and a length), a vertical clearance member (allowing clearance of knuckles and fingers when used), and a bar-engager; wherein the manual casket lifting and carrying system comprises the manual casket lifting and carrying assembly.

The manual casket lifting and carrying assembly comprises the handle member, the vertical clearance member, and the bar-engager in functional combination. The handle member comprises a lever. The bar-engager comprises a c-shape profile about the length; wherein a top-edge-lip opposes a bottom-edge-lip along the length; the top-edge-lip and the bottom-edge-lip each provide a stop to prevent movement of the handle member in relation to a handle of the casket. The bar-engager comprises a side opening along the length such that the top-edge-lip and the bottom-edge-lip define the side opening; wherein the bar-engager preferably comprises an arcuate tube.

The handle member comprises the body having the length (previously referred to); the length located between the proximate end and the distal end of the handle member. The proximate end and the distal end define parameters of the handle member; wherein the handle member is located perpendicular to the vertical clearance member, and the vertical clearance member is positioned perpendicular to the bar-engager. The handle member may comprise a cylindrical rod, and alternate versions may comprise grips or the like. The vertical clearance member extends from adjacent the distal end of the handle member allowing fingers of a user-carrier to wrap around the handle member for securing during an in-use condition; the user-carrier gripping to the proximate end on the body of the handle member during use. The handle member, when used, extends horizontally in relation to a sidewall of a casket.

The bar-engager is shaped to allow removable coupling about the handle of the casket. The cylindrical rod preferably comprises a length of about 18 inches to prevent leg contact by the user-carrier on the casket and to provide sufficient levering means for ease of use. The bar-engager is about 5 inches wide to accommodate spacing in arm(s) of the casket. As such, the manual casket lifting and carrying assembly is inter-changeably useable on both sides of the casket to a respective the handle. The manual casket lifting and carrying assembly is useful for allowing the user-carrier to carry the casket in a sufficiently comfortable extended-side-carry positioning.

A kit is also disclosed herein including: a plurality of the manual casket lifting and carrying assemblies (preferably 6 or 8), and a set of user-instructions. Other kit components such as religious books may be included.

A method of using a manual casket lifting and carrying system is described comprising the steps of: engaging a manual casket lifting and carrying assembly (preferably 6) about a handle of a casket (about the casket evenly for each pallbearer), lifting the casket, and carrying the casket. The method may further comprising the step of removing the manual casket lifting and carrying assembly from engagement with the handle once the casket is set down as desired. The present invention may be used from side-to-side interchangeably, as mentioned.

The present invention holds significant improvements and serves as a manual casket lifting and carrying system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, manual casket lifting and carrying system, constructed and operative according to the teachings of the present invention.

The various embodiments of the present invention will hereinafter be described in conjunction with the appended drawings, wherein like designations denote like elements.

DETAILED DESCRIPTION

Figure 1:
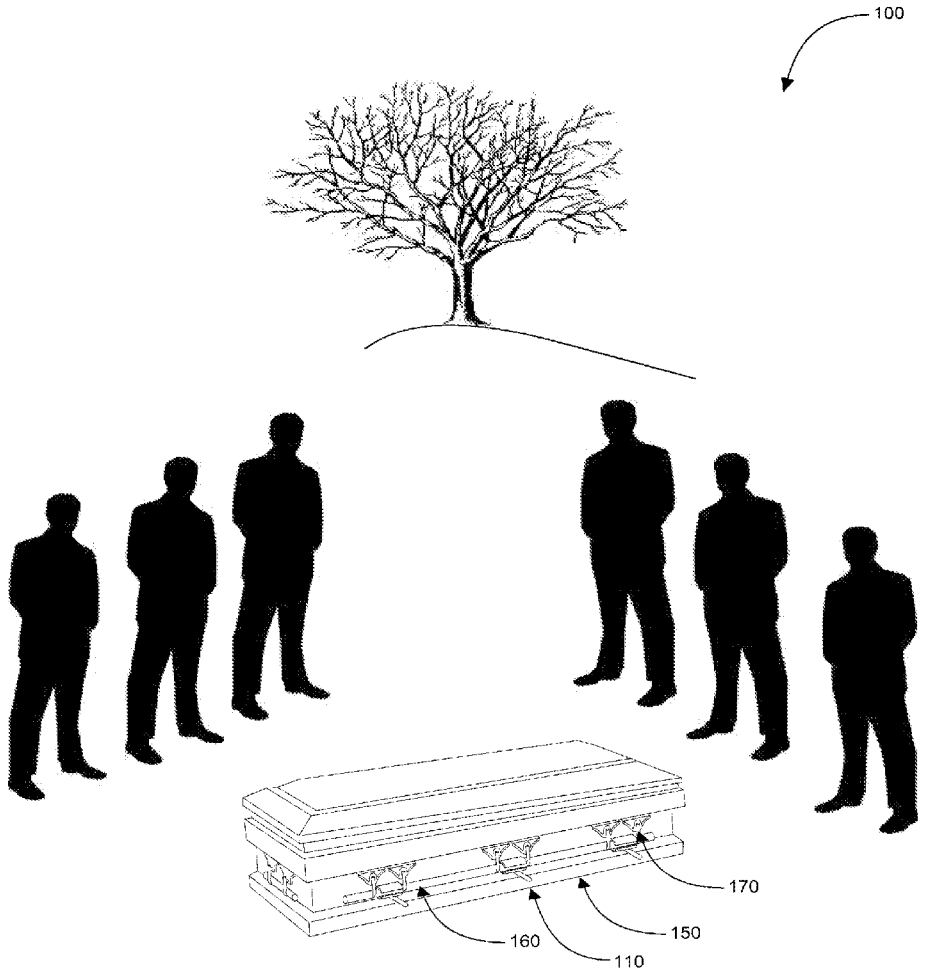
FIG. 1 shows a perspective view illustrating a manual casket lifting and carrying system in an in-use condition according to an embodiment of the present invention.
Figure 2:
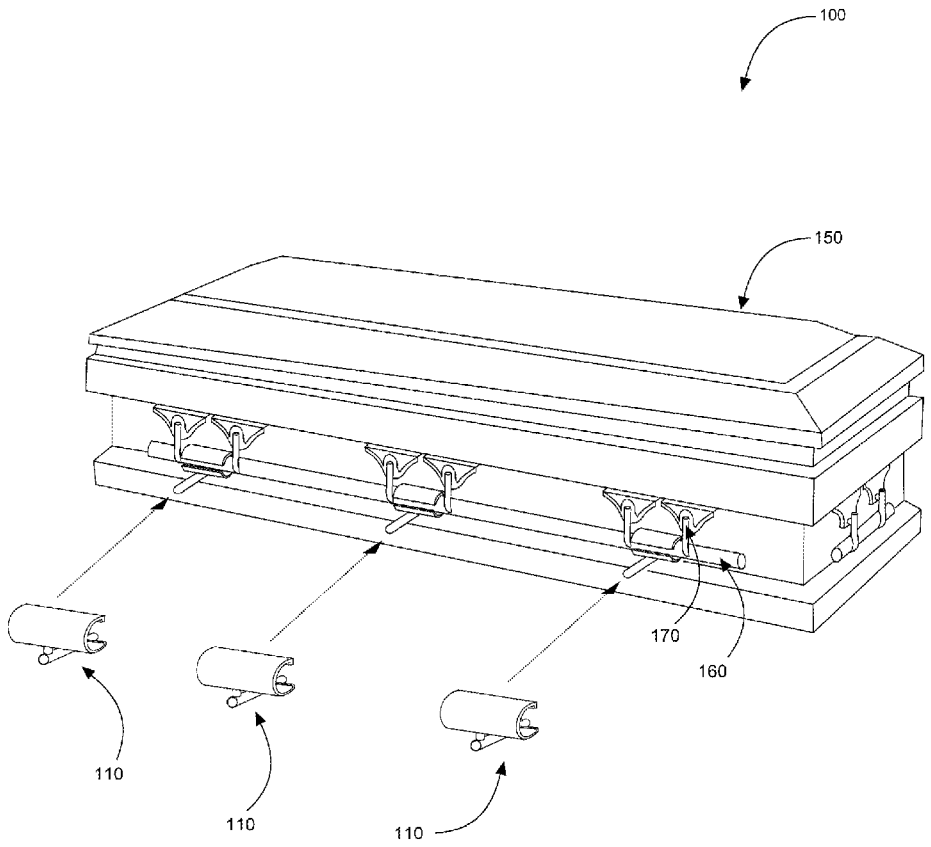
FIG. 2 is a perspective view illustrating the manual casket lifting and carrying system as installed for use according to an embodiment of the present invention of FIG. 1.

As discussed above, embodiments of the present invention relate to a carrying means and more particularly to a manual casket lifting and carrying system as used to improve the efficiency of lifting, stabilizing and carrying caskets.

Generally speaking, the manual casket lifting and carrying system comprises a funeral casket carrying device that is designed to allow for much easier transporting from a funeral to a graveside service, the coffin, allowing it to be maneuvered more easily, even up and down flights of stairs as necessary. The handle members may be about five inches wide. The handles may comprise two top slightly curved portions measuring about two inches across. The handy handle features a pivot rod about 18 inches in length and 1-1½ inches in diameter that allows for the handle to be used on either side of the casket. The handle may fold when not used (when not in extension) to become parallel with the casket. The handles when properly used put less strain on the casket bearers since they provide functionally accessible handles.

Referring generally to the drawings by numerals of reference there is shown in FIGS. 1-4, various views of manual casket lifting and carrying system 100. Manual casket lifting and carrying system 100 comprises: manual casket lifting and carrying assembly 110 comprising handle member 120 (having body 122, proximate end 124, distal end 126, and length 128), vertical clearance member 130, and bar-engager 140; wherein manual casket lifting and carrying system 100 comprises manual casket lifting and carrying assembly 110.

Figure 3:
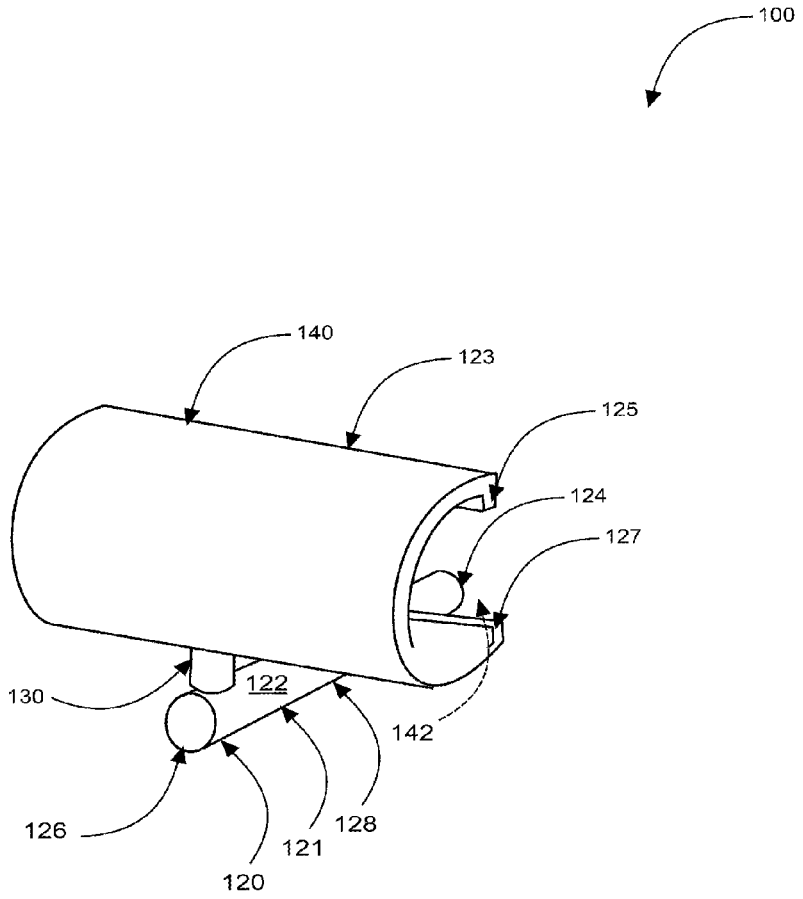
FIG. 3 is a perspective view illustrating a manual casket lifting and carrying assembly according to an embodiment of the present invention of FIG. 1.
Figure 4:
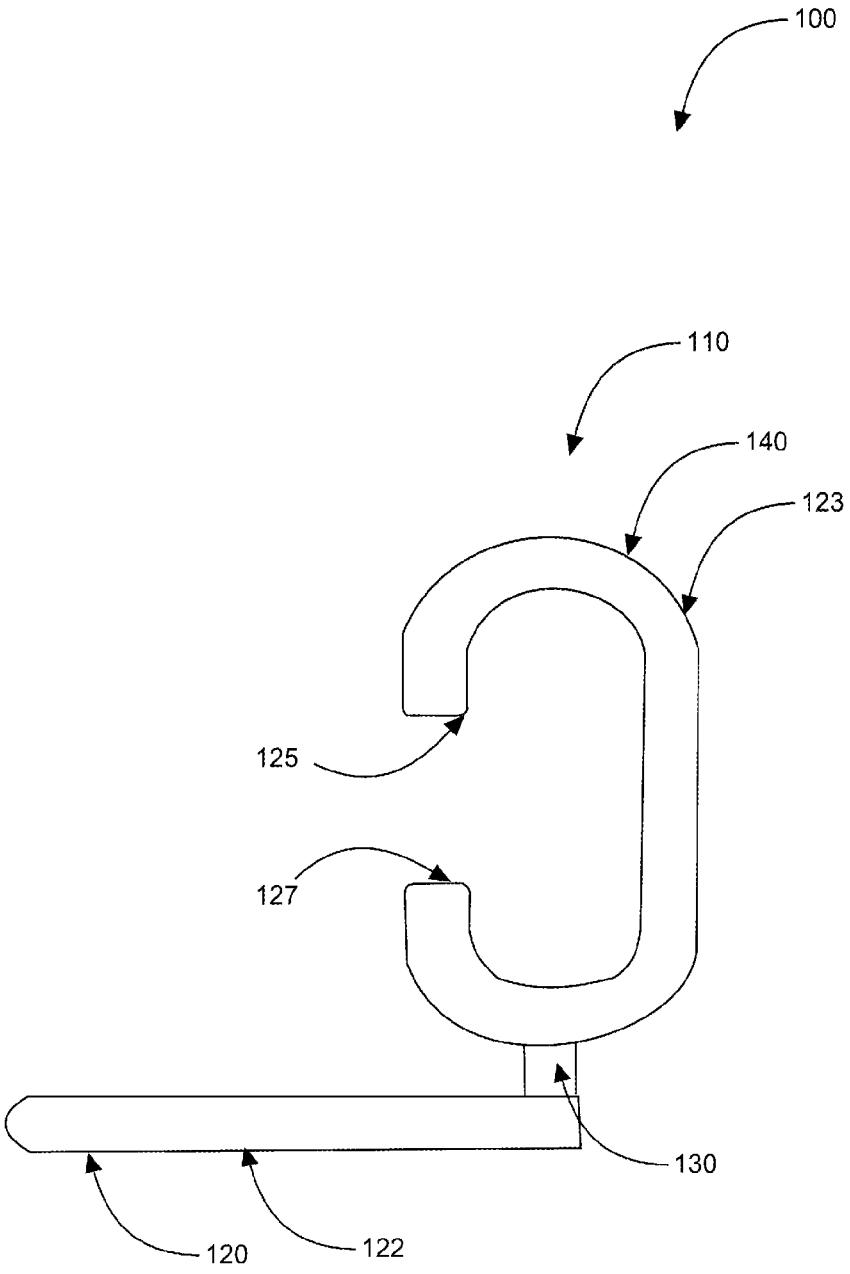
FIG. 4 is a side perspective view illustrating the manual casket lifting and carrying assembly (showing a handle member, a vertical clearance member, and a bar-engager in functional combination) according to an embodiment of the present invention of FIG. 1.

Manual casket lifting and carrying assembly 110 comprises handle member 120, vertical clearance member 130, and bar-engager 140 all in functional combination. Handle member 120 comprises body 122 having length 128; length 128 located between proximate end 124 and distal end 126 of handle member 120. Proximate end 124 and distal end 126 define parameters of handle member 120; wherein handle member 120 is located perpendicular to vertical clearance member 130, and vertical clearance member 130 is positioned perpendicular to bar-engager 140, as shown in FIGS. 3-4. Vertical clearance member 130 extends from adjacent distal end 126 of handle member 120 allowing fingers of a user-carrier to wrap around handle member 120 for securing during an in-use condition (as shown in FIG. 1); the user-carrier gripping to proximate end 124 on body 122 of handle member 120 during use. Handle member 120, when used, extends horizontally in relation to a sidewall of casket 150. Bar-engager 140 is shaped to allow removable coupling about handle 160 of casket 150. As such manual casket lifting and carrying assembly 110 is useful for allowing the user-carrier to carry casket 150 in a sufficiently comfortable extended-side-carry positioning, as shown in FIG. 1.

Handle member 120 comprises a lever (levering means for efficiency and comfort in lifting) and acts in the capacity of a moment arm. Referring now again to bar-engager 140; bar-engager 140 preferably comprises a c-shape profile 123 about length 128; wherein c-shape profile 123 comprises top-edge-lip 125 along length 128. Similarly, c-shape profile 123 comprises bottom-edge-lip 127 along length 128, as shown in FIGS. 3-4. Top-edge-lip 125 opposes bottom-edge-lip 127. Top-edge-lip 125 and bottom-edge-lip 127 each provide a stop (movement arrester) to prevent movement of handle member 120 in relation to handle 160 of casket 150.

Handle member 120 preferably comprises cylindrical rod 121 such that it doesn't 'cut' into the user-carrier's hands. Other profiles (shapes) may be available in alternate embodiments. Other sizes may be available as well. As designed, manual casket lifting and carrying assembly 110 is interchangeably useable on both sides of casket 150 to a respective handle 160.

In preferred embodiments cylindrical rod 121 comprises a length of about 18 inches to prevent leg contact by the user-carrier on casket 150. This feature length makes it much easier to carry casket 150 without hitting knees, legs etc. This also helps prevent user-carriers from stumbling from being off-balance and the like.

In certain embodiments handle member 120 is pivotable; and may be able to be folded for ease of storage. Handle member 120 may be extendable. Bar-engager 140 is about 5 inches wide to accommodate spacing in arm(s) 170 of casket 150. Bar-engager 140 comprises side opening 142 along length 128 such that top-edge-lip 125 and bottom-edge-lip 127 define side opening 142. Side opening 142 allows manual casket lifting and carrying assembly 110 to be removably couplable to handle(s) 160. In preferred embodiments bar-engager 140 comprises an arcuate tube.

Manual casket lifting and carrying system 100 may be sold as kit comprising the following parts: at least one manual casket lifting and carrying assembly 110 (preferably six); and at least one set of user instructions. The kit has instructions such that functional relationships are detailed in relation to the structure of the invention (such that the invention can be used, maintained, or the like in a preferred manner). Manual casket lifting and carrying system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different stopping/securing combinations, parts may be sold separately, etc., may be sufficient. Other kit components such as religious books may be included.

Figure 5:
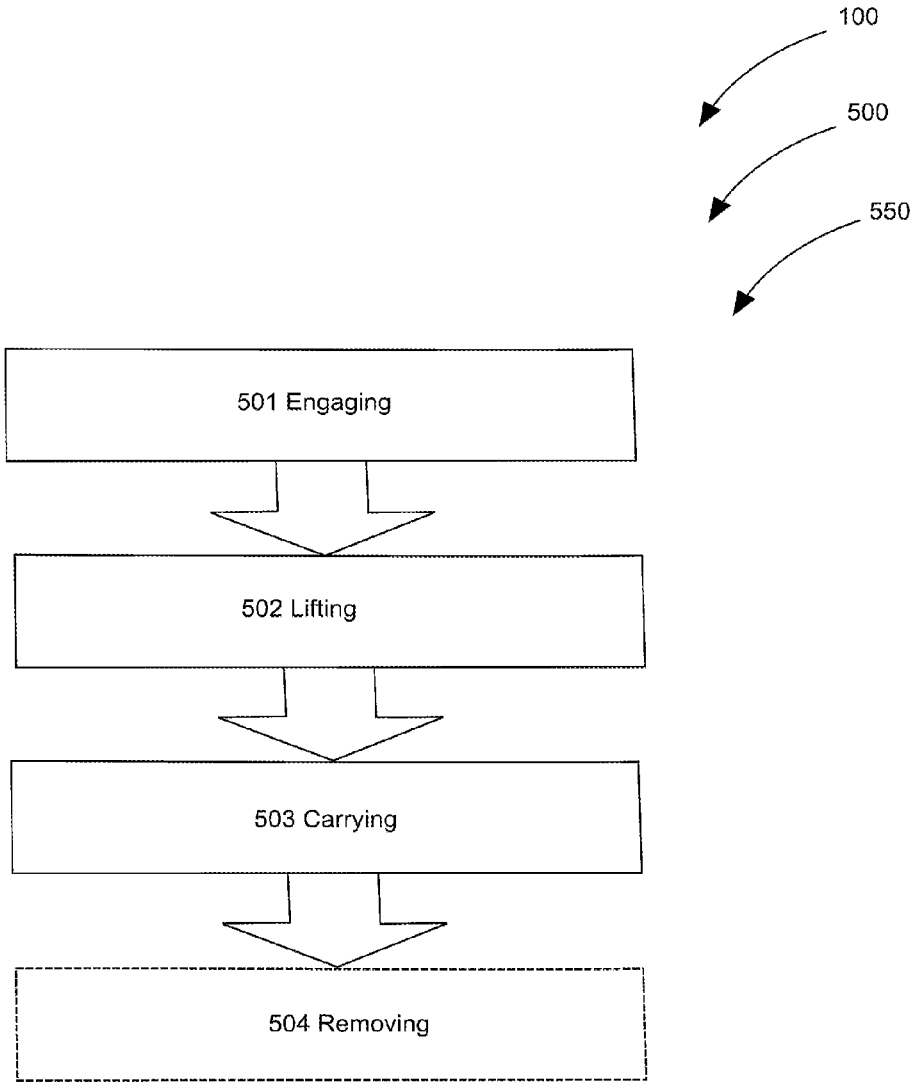
FIG. 5 is a flowchart illustrating a method of use for the manual casket lifting and carrying system according to an embodiment of the present invention of FIGS. 1-4.

Referring now to FIG. 5, showing a flowchart 550 illustrating method of use 500 for manual casket lifting and carrying system 100 according to an embodiment of the present invention of FIGS. 1-4.

A method of using (method of use 500) manual casket lifting and carrying system 100 comprises the steps of: step one 501 engaging manual casket lifting and carrying assembly 110 (preferably 6) about handle 160 of casket 150 (about casket 150 evenly for each pallbearer), step two 502 lifting casket 150, and step three 503 carrying casket 150. Method of use 500 may further comprise the step four 504 of removing manual casket lifting and carrying assembl(ies) 110 from engagement with handle 160 once casket 150 is set down as desired. The present invention may be used from side-to-side interchangeably, as mentioned.

It should be noted that step 504 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A manual casket lifting and carrying system comprising:

a) a manual casket lifting and carrying assembly comprising;

i) a handle member having;

(1) a body;

(2) a proximate end;

(3) a distal end; and (4) a length;

ii) a vertical clearance member; and iii) a bar-engager;

b) wherein said handle member comprises said body having said length, said length located between said proximate end and said distal end of said handle member;

c) wherein said proximate end and said distal end define parameters of said handle member;

d) wherein said handle member is located perpendicular to said vertical clearance member, and said vertical clearance member is positioned perpendicular to said bar-engager;

e) wherein said vertical clearance member extends from adjacent said distal end of said handle member for allowing fingers of a user-carrier to wrap around said handle member for securing during an in-use condition, said user-carrier gripping to said proximate end on said body of said handle member during use;

f) wherein said handle member, when used, extends horizontally in relation to a sidewall of a casket;

g) wherein said bar-engager is shaped to allow removable coupling about a handle of said casket; and h) wherein said manual casket lifting and carrying assembly is useful for allowing said user-carrier to carry said casket in a sufficiently comfortable extended-side-carry positioning.

2. The manual casket lifting and carrying system of claim 1 wherein said handle member comprises a lever.

3. The manual casket lifting and carrying system of claim 2 wherein said bar-engager comprises a c-shape profile about said length.

4. The manual casket lifting and carrying system of claim 3 wherein said c-shape profile comprises a top-edge-lip along said length.

5. The manual casket lifting and carrying system of claim 3 wherein said c-shape profile comprises a bottom-edge-lip along said length.

6. The manual casket lifting and carrying system of claim 3 wherein said bar-engager is about 5 inches wide to accommodate spacing in arms of said casket.

7. The manual casket lifting and carrying system of claim 1 wherein said handle member comprises a cylindrical rod.

8. The manual casket lifting and carrying system of claim 7 wherein said manual casket lifting and carrying assembly is inter-changeably useable on both sides of said casket to a respective said handle.

9. The manual casket lifting and carrying system of claim 8 wherein said cylindrical rod comprises a length of about 18 inches to prevent leg contact by said user-carrier on said casket.

10. The manual casket lifting and carrying system of claim 9 wherein said handle member is pivotable.

11. The manual casket lifting and carrying system of claim 10 wherein said handle member is able to be folded.

12. The manual casket lifting and carrying system of claim 1 wherein said handle member is extendable.

13. A manual casket lifting and carrying system comprising:

a) a manual casket lifting and carrying assembly comprising;

i) a handle member having;

(1) a body;

(2) a proximate end;

(3) a distal end; and (4) a length;

ii) a vertical clearance member; and iii) a bar-engager;

b) wherein said handle member comprises a lever;

c) wherein said bar-engager comprises a c-shape profile about said length;

d) wherein a top-edge-lip opposes a bottom-edge-lip along said length;

e) wherein said top-edge-lip and said bottom-edge-lip each provide a stop to prevent movement of said handle member in relation to a handle of a casket;

f) wherein said bar-engager comprises a side opening along said length such that said top-edge-lip and said bottom-edge-lip define said side opening;

g) wherein said bar-engager comprises an arcuate tube;

h) wherein said handle member comprises said body having said length, said length located between said proximate end and said distal end of said handle member;

i) wherein said proximate end and said distal end define parameters of said handle member;

j) wherein said handle member is located perpendicular to said vertical clearance member, and said vertical clearance member is positioned perpendicular to said bar-engager;

k) wherein said handle member comprises a cylindrical rod;

l) wherein said vertical clearance member extends from adjacent said distal end of said handle member for allowing fingers of a user-carrier to wrap around said handle member for securing during an in-use condition, said user-carrier gripping to said proximate end on said body of said handle member during use;

m) wherein said handle member, when used, extends horizontally in relation to a sidewall of a said casket;

n) wherein said bar-engager is shaped to allow removable coupling about said handle of said casket;

o) wherein said cylindrical rod comprises a length of about 18 inches to prevent leg contact by said user-carrier on said casket;

p) wherein said bar-engager is about 5 inches wide to accommodate spacing in arm(s) of said casket;

q) wherein said manual casket lifting and carrying assembly is inter-changeably useable on both sides of said casket to a respective said handle; and r) wherein said manual casket lifting and carrying assembly is useful for allowing said user-carrier to carry said casket in a sufficiently comfortable extended-side-carry positioning.

14. The manual casket lifting and carrying system of claim 13 further comprising a kit including:

a) a plurality of said manual casket lifting and carrying assemblies; and b) a set of user-instructions.

15. A method of using said manual casket lifting and carrying system of claim 13 comprising the steps of:

a) engaging said manual casket lifting and carrying assembly about said handle of said casket;

b) lifting said casket; and c) carrying said casket.

16. The method of claim 15 further comprising the step of removing said manual casket lifting and carrying assembly from engagement with said handle once said casket is set down as desired.

* * * * *